United States Patent [19]

Capezzuto et al.

[11] 4,392,425

[45] Jul. 12, 1983

[54] RETRACTABLE INK STAMP

[75] Inventors: John P. Capezzuto, Cambridge; Lewis H. Johnson, Mansfield, both of Mass.

[73] Assignee: Dennison Manufacturing Company, Framingham, Mass.

[21] Appl. No.: 253,992

[22] Filed: Apr. 13, 1981

[51] Int. Cl.[3] ..... B41K 1/50; B41K 1/56

[52] U.S. Cl. ..... 101/327; 101/379; 101/405

[58] Field of Search ..... 101/327, 368, 379, 382 MV; 101/405, 406, 367, 401.1; 118/264

[56] References Cited

U.S. PATENT DOCUMENTS

| | | | |
|---|---|---|---|
| 2,777,824 | 1/1957 | Leeds | 101/327 X |
| 2,891,472 | 6/1959 | Holzer | 101/405 X |
| 2,900,902 | 8/1959 | Becker | 101/327 X |
| 2,966,116 | 12/1960 | Harris et al. | 101/368 |
| 2,994,266 | 8/1961 | Sparrow | 101/382 MV |
| 3,019,201 | 1/1962 | Clancy et al. | 101/401.1 X |
| 3,158,094 | 11/1964 | Harris et al. | 101/327 |
| 3,468,252 | 9/1969 | Lemelson | 101/379 |
| 3,478,682 | 11/1969 | Funahashi | 101/368 X |
| 3,501,225 | 3/1970 | Martin et al. | 401/198 |
| 3,631,799 | 1/1972 | Funahashi | 101/327 |
| 3,755,517 | 8/1973 | Clancy et al. | 101/401.1 X |
| 3,952,653 | 4/1976 | McFarland | 101/327 |
| 4,228,736 | 10/1980 | Griffiths | 101/382 MV |

FOREIGN PATENT DOCUMENTS

| | | | |
|---|---|---|---|
| 2906406 | 8/1980 | Fed. Rep. of Germany | 101/327 |
| 668916 | 3/1952 | United Kingdom | 101/327 |

*Primary Examiner*—Clifford D. Crowder

*Attorney, Agent, or Firm*—Barry D. Josephs; Arthur B. Moore; George E. Kersey

[57] ABSTRACT

A retractable ink stamp having a handle and a stamp housing slidably positioned on one end of the handle with an ink absorbing stamp matrix located within the stamp housing. The matrix, preferably of polyethylene foam construction, functions as both an ink reservoir and ink stamp. The stamp matrix is durable, has increased ink absorbing capabilities, exhibits excellent capillary characteristics, but yet is easily manufactured at low cost.

9 Claims, 5 Drawing Figures

RETRACTABLE INK STAMP

CROSS REFERENCE TO RELATED APPLICATIONS

Patent application Ser. No. 208,604, now abandoned filed Nov. 20, 1980 entitled "WRITING IMPLEMENT" by John. P. Capezzuto and Lewis H. Johnson is related to the subject matter of this patent application, since it contains common subject matter.

FIELD OF THE INVENTION

The present invention relates to ink stamps, more particularly retractable ink stamps.

DESCRIPTION OF THE PRIOR ART

Prior art ink stamps typically have a wooden handle and an ink stamp attached to the handle, typically comprising a thin rubber pad which has been embossed with raised lettering. The rubber pad is generally attached to a planar surface to which the handle is affixed. Although ink stamps of this type are easy to fabricate and the stamp itself has long life, the principal disadvantage is that the ink stamp must be replenished with ink every few times that the stamp is used. Normally an ink pad reservoir separate from the ink stamp is used to replenish the surface of the ink stamp with a coating of ink by pressing the imprinted surface of the ink stamp periodically against the ink pad. Another principal disadvantage of such prior art ink stamps is that the working area around the ink stamp and ink pad tend to accumulate deposits of ink which cause considerable cleanup problems.

Retractable type ink stamps, which shield the exposed surface of the imprinted ink matrix, are disclosed in the prior art. The retractable mechanism which is employed is normally a spring connecting the ink matrix to the stamp handle. Springs have the disadvantage that they tend to corrode and their resiliency and stability begin to deteriorate after continued use. Larger springs should be used but they are difficult to install within the small space of the stamp handle. Another type of prior art ink stamp has an ink reservoir built either into the stamp handle or the ink stamp assembly. Such ink stamps obviate the need to use a separate ink pad to periodically recoat the surface of the embossed stamp matrix, but they tend to develop internal leakage after prolonged use. They are also difficult to repair.

Rubber matrices having increased ink absorbing capabilities have been disclosed in the prior art. These matrices reduce the need for having other ink reservoirs internally placed within the ink assembly or handle, but such rubber matrices are very costly owing to their unique composition and ink absorbing characteristics.

Applicants have overcome these disadvantages by producing a durable self-retracting ink stamp which does not require external ink reservoir or ink pad and which can be manufactured at lower cost than conventional retractable ink stamps.

SUMMARY OF THE INVENTION

An important object of the present invention is to provide a retractable ink stamp which obviates the need for external ink reservoirs or ink pads.

It is an object of the present invention to provide a retractable ink stamp wherein the stamp matrix functions as an ink reservoir in addition to providing an ink stamp surface having raised letters or design. It is another object of the present invention to provide a highly durable, resilient, but yet easily fabricated means for depressing and retracting the ink stamp assembly.

The retractable ink stamp of the present invention is comprised of a handle and stamp assembly slidably mounted to the handle. The stamp assembly comprises a stamp matrix which is connected to the handle by a self-retracting means for causing the stamp matrix to self-retract.

Applicants have determined that a stamp matrix comprised of polyethylene foam having a density between about 15 and 21 lbs./ft$^3$ provides a highly suitable ink stamp reservoir and is sufficiently strong and durable to permit molding of sharply defined raised letters or designs.

Applicants have determined that polyethylene foam of average pore diameter between about 36 and 48 microns is especially well suited for use as a stamp reservoir. An ink stamp matrix having polyethylene foam construction between about 15 to 21 lbs./ft.$^3$ density and an average pore size of between about 36 and 48 microns surprisingly provides increased capillary and ink transudating properties, but yet exhibits very high ink absorbing capabilities and durability upon impact.

The self-retracting means is comprised of a self-retracting member interconnecting the handle to the stamp assembly. The self-retracting member may be comprised of an elongated member having a plurality of folds therein, which may be connected to the handle or be formed integral with the handle.

Applicants have found that a self-retracting member comprises preferably of a polyolefin particularly polyethylene having circumferential folds therein achieves a bellows effect, is easily manufactured and provides a high degree of resiliency even after prolonged use. The retractable member and stamp housing are designed to permit the stamp matrix to extend preferably up to about $\frac{1}{8}$ inch from the open end of the stamp housing when the retractable means is fully depressed. The limited extension of the stamp matrix has been found to protect the low density polyethylene matrix from cracks or compression damage or prolonged use.

In another aspect of the invention, a plurality of alternate polyethylene matrices are removably fastened by friction fit or magnetic means within the handle interior. Any one of these alternate matrices are manually removable from the handle and are readily attachable to the stamp assembly to replace an existing matrix within the assembly. Thus in this aspect of the invention different stamp matrices housed within the same unit are interchangeable so that a user may select different imprint designs by simply replacing one matrix with another.

DESCRIPTION OF THE PREFERRED EMBODIMENTS

Figure 1:
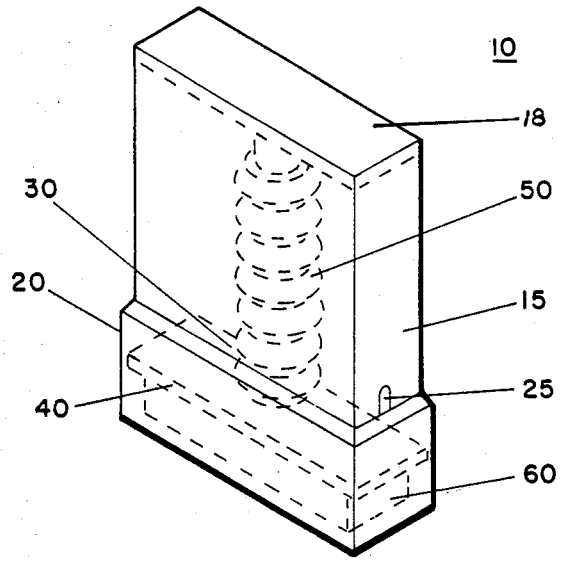
FIG. 1 is an isometric drawing of the retractable ink stamp of the present invention.
Figure 2:
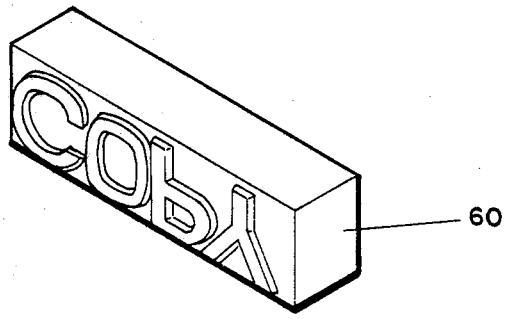
FIG. 2 is an isometric drawing of the stamp matrix.

The preferred embodiment of the retractable stamp of the invention is shown in FIG. 1. The retractable stamp 10 of the invention is comprised of a handle 15, a housing 20, and a stamp assembly 30. The stamp assembly 30 is comprised of an ink stamp matrix 60, a platform 40 for stamp matrix 60, and a resilient self-retracting member 50 for depressing and retracting stamp assembly 30. Matrix 60 has at least one surface imprinted with a raised imprint design as shown in FIG. 2. Matrix 60 is attached to the platform 40 preferably by fixing the side opposite the imprint design on matrix 60 to the under surface of platform 40 as illustrated in FIG. 1. Matrix 60 may be held in place against the under surface of platform 40 by adhesive, or may be removably secured thereto by snaps, fasteners, or by magnetic means (not shown). Platform 40 provides a flat rigid surface against which the matrix is braced as the ink stamp 10 is depressed. However, other structural supports for holding the matrix in place such as structural ribs or concavities within housing 20 or within handle 15 may be used instead of platform 40.

Alternatively, matrix 60 may be connected directly to retractable member 50 without use of platform 40 if the member 50 is sufficiently wide to provide adequate support for the matrix as ink stamp 10 is depressed.

Figure 3:
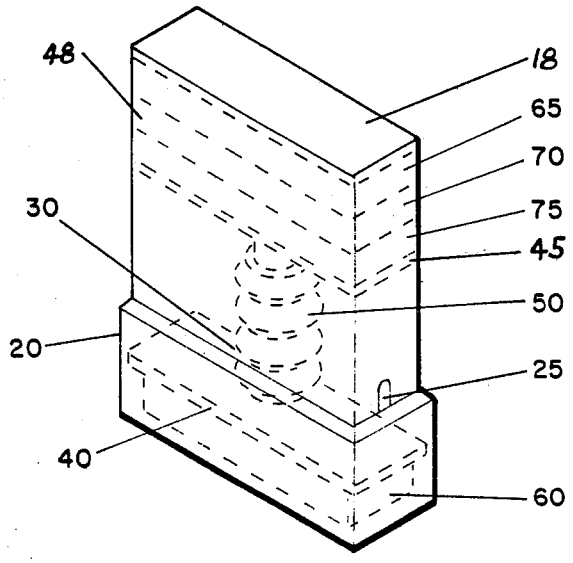
FIG. 3 is an isometric drawing of another embodiment of the invention having a plurality of removable alternate matrices within the ink stamp handle.

Self-retracting member 50 connects handle 15 to platform 40 and preferably has an elongated structure with at least one fold circumferentially around its surface to provide a bellows effect as member 50 is depressed. Retractable member 50 may have a plurality of folds concentrically located around its circumference to give the retractable means greater resiliency and permit accommodation of varying size handles 15 and housing 20. One end of member 50 is preferably secured to the top end 18 of handle 15 and the other end is secured to the platform 40. Alternatively, one end of member 50 may be secured to a platform 45 intermittently located inside handle 15 below top end 18 as best illustrated in FIG. 3 and the other end secured to platform 40 or directly to stamp matrix 60. Member 50 is preferably an elongated member of polyethylene construction and may be fabricated by the process of blow molding. Although polyolefins, particularly polyethylene, has the important advantage that it gives high resiliency and stability suitable for the intended purpose and is easy to fabricate, it should be appreciated that other synthetics may also be equally suitable. For example, retractable member 50 may be constructed of polyvinyl chloride, or polyvinyl fluoride, or the equivalents thereof. Although retractable member 50 is preferably of elongated cylindrical shape, other shapes may be employed without departing from the scope of the invention. For example, elongated member 50 may have a polygonal or oblong cross sectional shape. It has been determined that employing at least one fold and preferably plurality of folds circumferentially around the surface of member 50 provides sufficient bellows effect to give adequate resiliency and stability to the member to permit self retraction of the handle 15 after it has been depressed and released. Although the ink stamp of the invention is operable with but one elongated member 50, it should be appreciated that a plurality of such members may also be employed. Also instead of utilizing a bellows effect, spring means may be employed to give a desired resiliency between the stamp matrix 60 and handle 15 allowing the stamp matrix 60 to be easily depressed and self-retracting.

Stamp housing 20 is slidably positioned around the open end of handle 15. Preferably there are guides 25 which comprise surface depression and/or small rails located along the side edges of handle 15. Guides 25 interconnect with corresponding protrusions or rails within the side surface of housing 20 to permit easy sliding movement between handle 15 and housing 20. Since housing 20 is slideably positioned around the open end of handle 15, as handle 15 is manually depressed it slides downwardly into housing 20 and when released, the resiliency of elongated member 50 is sufficient to cause the handle 15 to self-retract.

It has been determined that a stamp matrix 60 comprised of polyethylene having a density of between about 15 and 21 lbs./ft.$^3$ polyethylene and average pore diameter of between about 36 and 44 microns is sufficiently durable on impact and exhibits excellent ink absorbing and transudating characteristics.

In use when the matrix 60 is saturated with conventional non-drying ink such as a glycerin based stamp pad ink and as handle 15 is depressed with the open end of housing 20 flush against a paper surface, the stamp assembly 30 including matrix 60 comes into contact with the paper surface leaving a clear ink imprint on the paper. After the ink imprint has been made, handle 15 may be released, and it then self-retracts to its resting position withdrawing stamp assembly 30 into stamp housing 20. When handle 15 is fully depressed, the stamp matrix 60 extends only slightly from the open end of housing 20, preferably about 1/16 inch and as high as about $\frac{1}{8}$ inch the open end of housing 60. The small extension of matrix 60 from the open end of stamp housing 20 permits adequate contact between paper and the imprint design to allow for a clear ink printing, but yet does not expose the matrix 60 to possibility of cracking or compression damage.

Figure 4:
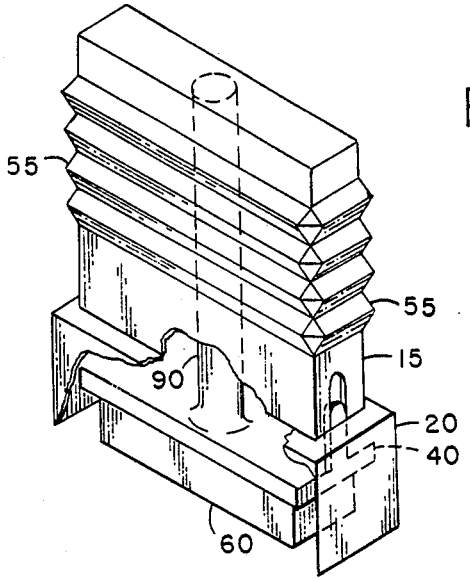
FIG.4 is a perspective drawing of another embodiment of the invention having folds placed circumferentially around the handle.

Alternatively instead of employing a self-retracting member 50 as illustrated in FIG. 1 the handle may include a plurality of folds 55 which are formed integral with handle 15 and circumventing handle 15 as best shown in FIG. 4. Folds 55 provide a means for causing the matrix assembly to self-retract after it has been depressed.

A member 90, preferably of solid construction, e.g. of solid cylindrical shape, is provided to connect with handle 15 to platform 40 thus interconnecting handle 15 with matrix 60. In use after matrix 60 is saturated with conventional nondrying ink and as handle 15 is depressed matrix 60 comes into pressure contact with a paper surface leaving a clear ink imprint on the paper. Folds 55 are preferably molded integral with handle 15 by conventional molding methods such as injection molding. Folds 55 are preferably of the same composition as handle 15, preferably of polyolefin, particularly low density polyethylene construction. Folds 55 provide sufficient resiliency and structural stability to permit the stamp assembly including matrix 60 to self-retract into housing 20 after handle 15 has been depressed and released.

Ink stamp 10 is preferably of compact size so that it may be held in the palm of the user's hand. Typically handle 15 may have overall dimensions of about 1-$\frac{5}{8}$ inches in length and about 1-$\frac{5}{8}$ inches wide and about $\frac{1}{2}$ inch thick. Housing 20 may typically have dimensions 1-$\frac{7}{8}$ inches in length, 1-$\frac{3}{4}$ inches wide and about $\frac{5}{8}$ inch thick. It should be appreciated that the aforesaid dimensions are intended only as illustrative of dimensions suitable for production of a compact hand held ink stamp of the invention. If the concept of the invention is equally applicable to proportionally larger ink stamps which are not intended to be hand held but may be fixed to a table surface or adapted to be machine operated.

The matrix 60 is preferably comprised of polyethylene foam having a lightweight density in the range of between about 15 to 21 lbs./ft.$^3$, an average pore size of between about 36 to 44 microns average diameter and a pore volume of between about 25 to 45 volume percent of the total matrix volume. The matrix vertical thickness may be between about ⅛ inch to 1 inch preferably about ¼ to ½ inch. The total volume of the matrix should be at least about 0.06 cubic inches. With a matrix having dimensions about ½ inch in thickness and a length of about 1-½ inches and a depth of ½ inch as many as about 3000 to 6000 stamp imprints can be made by saturating the matrix with conventional glycerine based or equivalent nonevaporating stamping ink. The polyethylene foam having the above physical characteristics has an open cell structure and can be manufactured from polyethylene granules by conventional methods such as cast molding methods suitable for forming foamed polyethylene, for example by methods disclosed in U.S. Pat. No. 3,628,876. The polyethylene foam having the aforementioned porosity and physical characteristics exhibits very high internal surface area which accounts for its ink absorbing capability, high capillary and transudating ability, but yet has sufficient internal strength that permits its continued use, for example up to as high as about 6000 stamp imprints without exhibiting significant wear or cracks. Although polyethylene foam is preferred, other polymer foams such as, for example polypropylene, polyvinyl chloride, or polyvinyl fluoride may be adapted for use in the scope of the present invention.

An alternate embodiment of the invention is illustrated in FIG. 3. In the embodiment shown in FIG. 3 a plurality of alternate matrices such as alternate matrix 65, 70 and 75 may be magnetically housed within the handle 15. In this embodiment any one of the alternate matrices may be readily removed from the handle and used to replace existing stamp matrix 60 secured to the platform 40. Preferably the alternate matrices are held in place by friction fit or by magnetic means so that they may be readily removed from handle 15 and used to replace matrix 60 in stamp assembly 30. In this embodiment matrix 60 is also held in place against platform 40 preferably by friction fit or magnetic means. Thus the user has easy access to alternative imprint designs and can readily substitute one design for another within the same unit. Although the alternate matrices are preferably secured to a handle 15 magnetically it should be understood that snapable means or friction means or the equivalent may be used to removably secure these alternate matrices to handle 15. The retractable member 50 is preferably secured at one end to a support member 45 located in the handle 15. Support member 45 is located intermediate the top end 18 of the handle and the stamp housing 20 to provide a chamber 48 within handle 15. The chamber 48 is conveniently adapted to house the plurality of alternate matrices, typically four alternate matrices as best illustrated in FIG. 3. In operation the embodiment shown in FIG. 3 is utilized in the same manner as the embodiment of FIG. 1 once the alternate matrix is secured in place to platform 40 within stamp housing 20. The alternate matrices are preferably of the same construction as matrix 60, preferably of light weight polyethylene foam having the aforementioned preferred physical characteristics.

Figure 5:
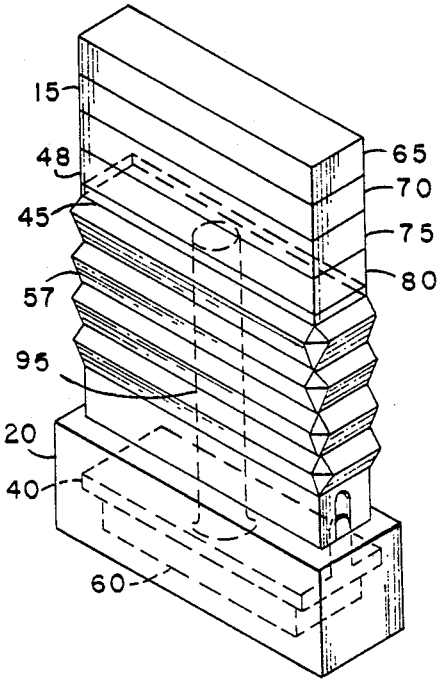
FIG. 5 is a perspective view of an embodiment having folds around the handle and stored alternative stamp matrices.

Alternatively instead of employing a self-retracting member 50 as illustrated in FIG. 3, the handle may include a plurality of folds 57 integral with the handle 15 and placed circumferentially around handle 15 as best shown in FIG. 5. Folds 57 illustrated in FIG. 5 are similar to folds 55 shown in FIG. 4 except that folds 57 are located in the lower half of handle 15 so that an empty chamber 48 is formed in the upper portion of handle 15. A platform 45 is secured inside handle 15 to the walls of handle 15, preferably at a point within the lower half of the handle interior space. A member 95 preferably of a solid cylindrical construction is provided to connect platform 45 with platform 40, thus interconnecting matrix 60 with handle 15. Thus in the embodiment the stamp assembly comprises member 95, platform 45, platform 40 and matrix 60.

Alternate matrices, e.g. matrices 65, 70, 75 and 80 can be removably stored in chamber 48 as shown in FIG. 5. The alternate matrice may be removably stored in chamber 48 by friction fit or magnetic means and used interchangeably with matrix 60 as above described with reference to the embodiment disclosed in FIG. 3. Folds 57 are molded integral with handle 15 by conventional molding techniques such as injection molding. Preferably folds 57 are of polyolefin construction, particularly low density polyethylene. In use folds 57 provide sufficient resiliency and stability to cause the stamp assembly including stamp matrix 60 to self-retract into housing 209 after it has been depressed and released.

While the present invention has been described with reference to several preferred embodiments it should be appreciated that other embodiments are possible without departing from the scope of the invention. Therefore the invention is not intended to be limited by the description in the specification, but only by the language of the claims and equivalents thereof.

What is claimed is:

1. A retractable ink stamp comprising:

a handle, an ink stamp housing slideably mounted to one end of the handle, and a retractable ink stamp assembly located substantially within the ink stamp housing, said ink stamp assembly comprising an ink stamp matrix having a thickness in a range between about ⅛ inch to 1 inch and a total volume of at least 0.06 cubic inches, said stamp matrix constructed of a nonelastomeric polymer foam having an open cell structure, an average pore diameter of between about 36 to 44 microns and a pore volume of about 25 to 45 percent of the total matrix volume, the polymer foam selected from the group consisting of polyethylene, polypropylene, polyvinylchloride and polyvinyl/fluoride, and means for self-retracting the ink stamp matrix, said means comprised of a member having at least one fold circumferentially within its surface to produce a bellows effect within the member as the handle is depressed, said means interconnecting the stamp matrix and said handle so that as the handle is depressed, the housing and handle slide towards each other causing a minor portion of the matrix to extend beyond the open end of said ink stamp housing, and as said handle is released, said self-retracting means causes the ink matrix to withdraw into the interior of the stamp housing.

2. A retractable ink stamp as in claim 1 wherein the stamp matrix extends to a maximum of ⅛ inch from the open end of the stamp housing when said handle is fully depressed.

3. A retractable ink stamp as in claim 1 wherein the self-retracting means is formed integral with said handle.

4. A retractable ink stamp as in claim 1 wherein the self-retracting means is comprised of a polyolefin.

5. A retractable ink stamp as in claim 1 wherein the self-retracting means is comprised of low density polyethylene.

6. A retractable ink stamp as in claim 1 wherein the self-retracting means is comprised of polypropylene.

7. A retractable ink stamp as in claim 1 wherein the ink stamp matrix is comprised of low density polyethylene foam.

8. A retractable ink stamp as in claim 7 wherein the polyethylene foam has a density of between about 15 to 21 lbs./ft.$^3$.

9. A retractable ink stamp as in claim 1 wherein the stamp assembly further includes a platform member affixed to one end of the self-retracting means and the stamp matrix is affixed to the platform, the platform being sandwiched between the self-retracting means and the matrix.

* * * * *